United States Patent [19]

Baumann

[11] Patent Number: 5,030,065

[45] Date of Patent: Jul. 9, 1991

[54] RECIPROCATING COMPRESSOR

[75] Inventor: Heinz Baumann, Winterthur, Switzerland

[73] Assignee: Sulzer Brothers Limited, Winterthur, Switzerland

[21] Appl. No.: 493,964

[22] Filed: Mar. 13, 1990

[30] Foreign Application Priority Data

Mar. 23, 1989 [CH] Switzerland ..... 01086189

[51] Int. Cl.[5] ..... F04B 1/04

[52] U.S. Cl. ..... 417/273; 74/50

[58] Field of Search ..... 417/262, 266, 273; 74/49, 50

[56] References Cited

U.S. PATENT DOCUMENTS

| | | | |
|---|---|---|---|
| 2,309,551 | 1/1943 | Tropp et al. | 417/273 X |
| 2,312,057 | 2/1943 | Williams | 74/49 |
| 2,345,125 | 3/1944 | Huber | 417/273 X |
| 2,366,237 | 1/1945 | Clausen | 74/50 |
| 2,642,748 | 6/1953 | Widmer | 74/49 |
| 3,067,624 | 12/1962 | Norton et al. | 74/50 |
| 3,259,074 | 7/1966 | Erdmann | 103/174 |
| 3,945,766 | 3/1976 | Gelon | 417/273 |
| 4,673,337 | 6/1987 | Miller | 417/273 |

FOREIGN PATENT DOCUMENTS

| | | |
|---|---|---|
| 2120101 | 11/1962 | Fed. Rep. of Germany . |
| 7323927 | 6/1973 | Fed. Rep. of Germany . |
| 2821389 | 11/1978 | Fed. Rep. of Germany . |
| 0387409 | 3/1933 | United Kingdom . |
| 0881430 | 11/1961 | United Kingdom . |

*Primary Examiner*—John C. Fox

*Attorney, Agent, or Firm*—Kenyon & Kenyon

[57] ABSTRACT

The reciprocating compressor is made with yoke units which connect opposite pairs of pistons while eliminating play between the yoke units and sliding block. Each yoke unit includes a pair of shoes which are removably secured to the pistons and which are adapted to guide the sliding block moved by a crankshaft. Each yoke unit also includes a clamp ring which surrounds the shoes and which biases the shoes towards the sliding block. The shoes are removably secured to the pistons to permit the yoke unit to be readily disassembled. Bow-shaped clamping members may also be employed within each yoke unit to further bias the clamp ring against the shoes.

13 Claims, 2 Drawing Sheets

RECIPROCATING COMPRESSOR

This invention relates to a reciprocating compressor. More particularly, this invention relates to a reciprocating compressor for the compressing of gaseous fuels.

As is known, various types of compressors have been known for the compressing of gases such as natural gas, for example for use as fuel. In some cases, the compressors have been constructed with at least two cylinders connected in series with each cylinder containing a piston. In addition, the pistons have been disposed in pairs one opposite the other on a common axis while being coupled to a sliding block via a yoke. The block, in turn, has been guided for movement transversely of a common axis between two parallel guide surfaces formed on the yoke with a crank pin of a drive shaft engaging in the block.

For example, a four stage small-capacity compressor of this type is described in U.S. Pat. No. 4,936,327 and European Patent Application 0269082 and is used for high pressure. Two pairs of pistons are disposed with a 90° offset from one another and the yokes are each made in one piece and provided with a slot in which the associated sliding block constructed in the form of a square is guided via linear needle bearing systems. The exact guidance of the sliding block, which is important for reliable and minimum-maintenance operation of such compressors, requires very accurate machining of those parts which cooperate via a rolling bearing system or sliding surfaces in the case of the known constructions, particularly in the case of compressors for high pressures, in which correspondingly high bearing forces occur. However, this means that the production costs for the yoke and the sliding block are correspondingly expensive.

Other types of compressor arrangements have also been known for interconnecting opposed pairs of piston. For example, U.S. Pat. No. 2,312,057 describes a mechanical movement in which opposed pairs of pistons are interconnected by links which straddle a crankshaft used to drive the pistons. In addition, use has been made of a spring to resiliently force the pistons of the pair toward each other to confine associated rollers between the pistons and the crankshaft. However, such a construction is rather cumbersome and does not permit the links and springs to be removed as a unit for maintenance or repair purposes in a simple manner.

German O.S. 2 120 101 describes a radial compressor which employs a bow-shaped wire for interconnecting two opposed pistons in contact with a bearing on a crankshaft. However, due to the bow shape of the wire, play can readily occur between the pistons and the bearing during use since the legs of the wire may readily flex relative to each other.

Accordingly, it is an object of the invention to reduce the cost of constructing a reciprocating compressor having multiple cylinders.

It is another object of the invention to ensure substantially play-free accurate parallel guidance of the pistons of a reciprocating compressor during operation.

It is another object of the invention to provide a relatively simple structure for avoiding play between the pistons and a sliding block of a reciprocating compressor.

Briefly, the invention provides a reciprocating compressor which has at least one pair of cylinders disposed on a common axis with a piston reciprocally mounted in a respective cylinder on the axis, a sliding block disposed between the pistons and a crank pin of a drive motor disposed in the block for moving the block transversely of the axis. In accordance with the invention, a pair of shoes are provided with each shoe being removably secured to a respective piston and disposed between a respective piston and the block. In addition, each shoe has a guide surface facing the block to accommodate the transverse motion of the block during operation of the compressor.

Still further, the invention provides a means which bears on and biases the shoes under a prestress toward the block in parallel to the common axis of the cylinders. This means may be in the form of at least one elastically deformable supporting clamp ring which surrounds the shoe and the block for biasing the shoes towards the block under a prestress.

The shoes and the clamp ring together define a yoke unit which is of relatively simple construction. In addition, the yoke unit ensures that the shoes are pressed against the sliding block with a predetermined prestress, for example via cooperating sliding surfaces or via rolling bearings. Accordingly, the drive is transmitted to the pistons via the sliding block and shoes without any impact.

These and other objects and advantages of the invention will become more apparent from the following detailed description taken in conjunction with the accompanying drawings wherein.

Figure 1:
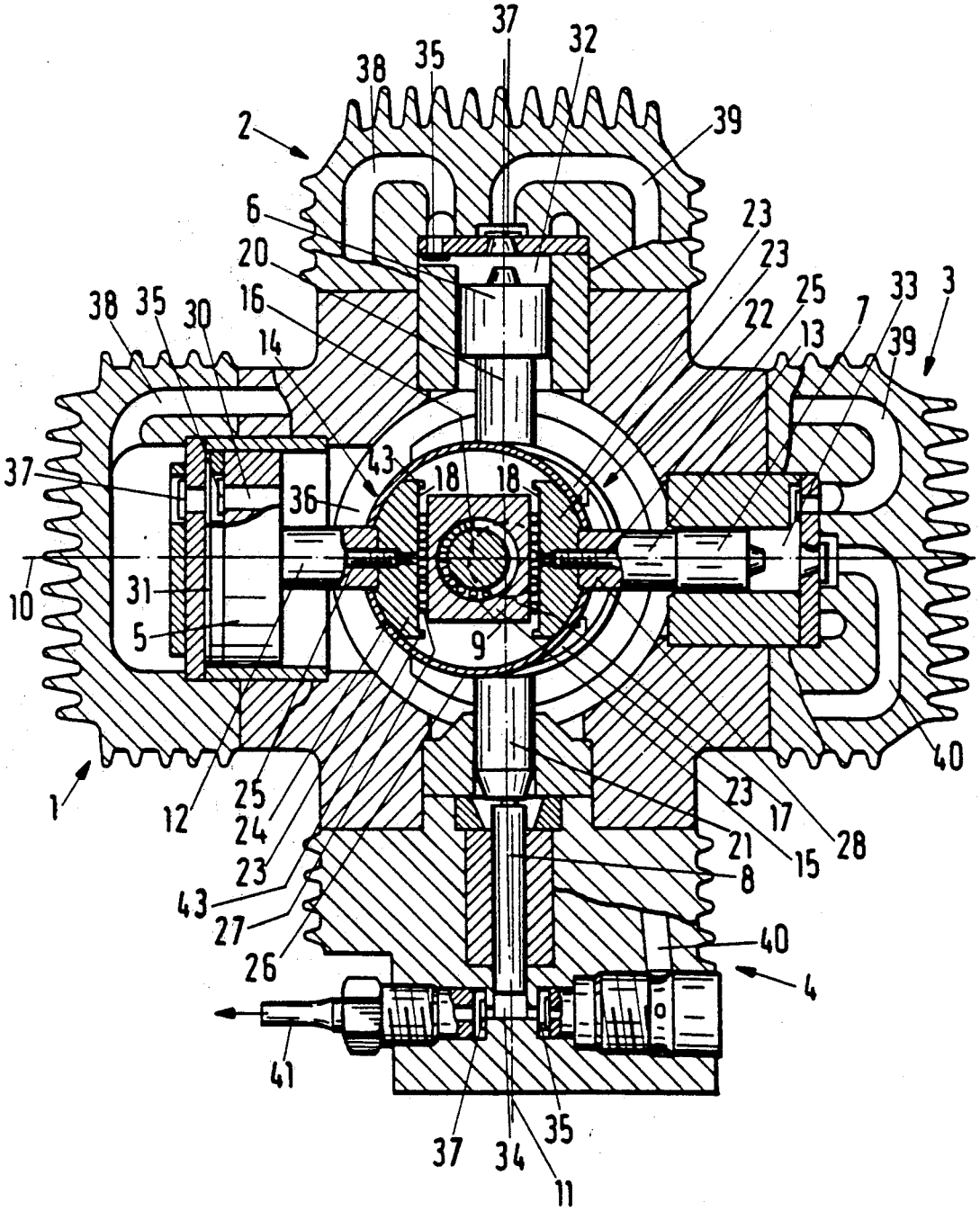
FIG. 1 illustrates a cross sectional view of a compressor constructed in accordance with the invention.

Referring to FIG. 1, the compressor which operates as a small capacity compressor comprises four cylinders 1, 2, 3 and 4 in which pistons 5, 6, 7 and 8 are reciprocally guided. The opposed pair of cylinders 1, 3 has a common horizontal axis 10 lying in the drawing plane, while the other pair of cylinders 2, 4, are disposed on a common horizontal axis 11 set back from the drawing plane. The pistons 5, 7 are coupled, by means of a yoke unit 14 connecting their piston rods 12, 13 to a square sliding block 15 which is mounted on a crankpin 16 of a vertical crankshaft 17 by means of a plain bearing system or, as indicated in FIG. 1, via a rolling bearing system (needle bearing) 9 to be movable transversely of the axis 10 between the two cylinders 1, 3. The crankshaft 17 is connected to a motor (not shown), e.g. an electric motor.

The pistons 6, 8 are coupled via a second yoke unit 22 connecting their piston rods 20, 21 to a second sliding block (not shown) mounted on the crankpin 16 and movable transversely of the axis 11 offset 90° from the yoke unit 14.

The yoke unit 14 illustrated in FIG. 1 is composed of a pair of shoes 23 and means in the form of an elastically deformable supporting clamp ring 26. As illustrated, each shoe 23 has a flat guide surface 18 facing the sliding block 15 so that the two shoes 23 provide parallel guide surfaces 18 for guiding the sliding block 15 transversely thereof. Each shoe 23 is rigidly connected to one of the piston rods 12, 13 in any desired manner, for example, by means of a screw 25, and on the side facing the associated piston, has a cylindrical respect surface 24. The shoes 23 can cooperate with the block 15 by way of plain bearing systems or, as shown in FIG. 1, via rolling bearing systems 27 such as linear needle bearings.

The clamp ring 26 surrounds the shoes 23 and the block 15 for biasing the shoes 23 towards the block 15 in parallel to the axis 10 between the two cylinders 1, 3 under a prestress. The clamp ring 26 is fitted onto the support surfaces 24 under a predetermined prestressing to cause the shoes 23 to be pressed, by a corresponding predetermined biasing force by way of the rolling bearing systems 27, against guide surfaces 19 of the block 15. Correspondingly, the shoes 23 of the second yoke unit 22 are braced against the guide surfaces 19 of the second block (not shown), these surfaces extending parallel to the axis 10. This arrangement ensures that the pistons 5, 7 are coupled without any play in the direction of the axis 10 and that the pistons 6, 8 are coupled without play in the direction of the axis 11 to the associated sliding blocks. This ensures a correspondingly impact-free drive connection between the crankpin 16 and the pistons 5, 6, 7 and 8. The connection between the clamp ring 26 and the shoes 23 is secured by the piston rods 12, 13; 20, 21 which are each taken to the associated shoe 23 through an aperture 28 formed at the circumference of the clamp ring 26.

The compressor has a valve arrangement which operates, for example as described in U.S. Pat. No. 4,936,327. For example, the piston 5 which is shown in its top dead center position, has a plurality of intake valves 35 each associated with an aperture 30. Only one such valve is shown. The intake valves 35 each establish a connection, during the intake stroke of the piston 5, between a compression chamber 31 of the cylinder 1 forming the first compression stage and the central crank chamber 36 of the compressor. The crank chamber 36 is connected to a feed line (not shown) for the gas for compression, e.g. natural gas, which is fed to the crank chamber 36 at a pressure of, for example, 10 mbar and is sucked into the compression chamber 31. During the compression stroke, the gas is compressed to a pressure of, for example, 5 bar and is fed, through delivery valves 37 in the head of cylinder 1 (only one such valve is shown) via a connecting duct 38 to the second compression stage formed by the cylinder 2.

In the cylinder 2, the gas is drawn into a compression chamber 32 on the intake stroke of the piston 6, through intake valves 35 in the cylinder head, while on the subsequent compression stroke it is compressed to a pressure of, for example, 20 bar and fed, via a central delivery valve 37 and a connected duct 39, to the third compression stage formed by the cylinder 3, the piston 7 of which is shown in its bottom dead-center position. The gas drawn into the compression chamber 33 on the intake stroke of the piston 7 is correspondingly compressed in the cylinder 3 on the subsequent compression stroke to a pressure, for example, 60 bar and delivered via a connecting duct 40 to the final pressure stage formed by the cylinder 4.

In the cylinder 4, the gas drawn into the compression chamber 34 on the intake stroke of the piston 8 is compressed, on the compression stroke, to a pressure of, for example, 200 bar and delivered via the delivery valve 37 to the delivery line 41 which may be connectable to a pressure vessel (not shown) for the compressed gas. The pressure vessel may, for example, be in the form of a motor vehicle gaseous fuel tank.

The intake valves 35 and delivery valves 37 may be constructed in any desired manner.

As shown in FIG. 1, the shoes 23 may be constructed with lateral stops 43 which limit the range of movement of the rolling bearing systems 27.

Figure 2:
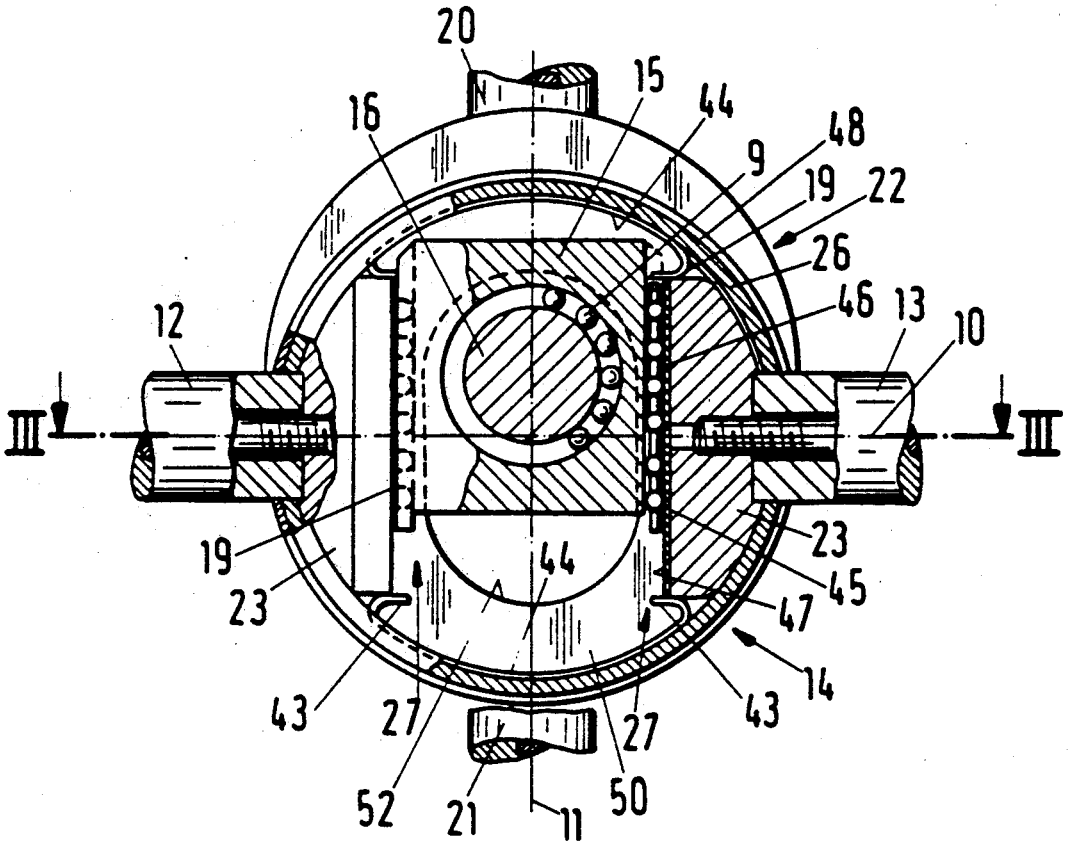
FIG. 2 illustrates a detailed cross-sectional view of a modified reciprocating compressor constructed in accordance with the invention.

Referring to FIG. 2, wherein like reference characters indicate like parts as above, each yoke unit 14, 22 may also include a pair of bow-shaped clamping members, each of which is inserted between a pair of shoes 43 and the clamp ring 26. As illustrated, each clamping member 44 has two bent-up ends which are adapted to be resiliently braced against the facing sides of the shoes 23. These ends also define stops 43, as above, to limit the rolling action of the rolling bearing arrangement 27. Each bent end 43 extends in parallel to the common axis 10, 11.

The bow-shaped clamping members 44 can be disposed so as to exert an outwardly directed biasing force on the clamp ring 26 to further ensure a biasing of the shoes 43 inwardly of the clamping ring 26, that is, toward the sliding block 15.

As shown in FIG. 2, the rolling bearing systems 27 each comprise a plurality of needle-shaped rolling elements 45 disposed in a cage movable between the stops 43.

As also shown in FIG. 2, a lining 47 formed of a wear resistant material such as hardened steel is disposed as a guide surface on each shoe 43 for the rolling of the rolling elements 45 thereon. Each lining 47 may be formed by a plate securable on a shoe 23 in any desired manner, e.g. by means of a solder connection. Alternatively, the linings 47 may be formed by an appropriately applied layer of a material having appropriate bearing properties, e.g. a ceramic material. The block 15 may also be provided with a corresponding lining or be made from a wear-resistant material.

Figure 3:
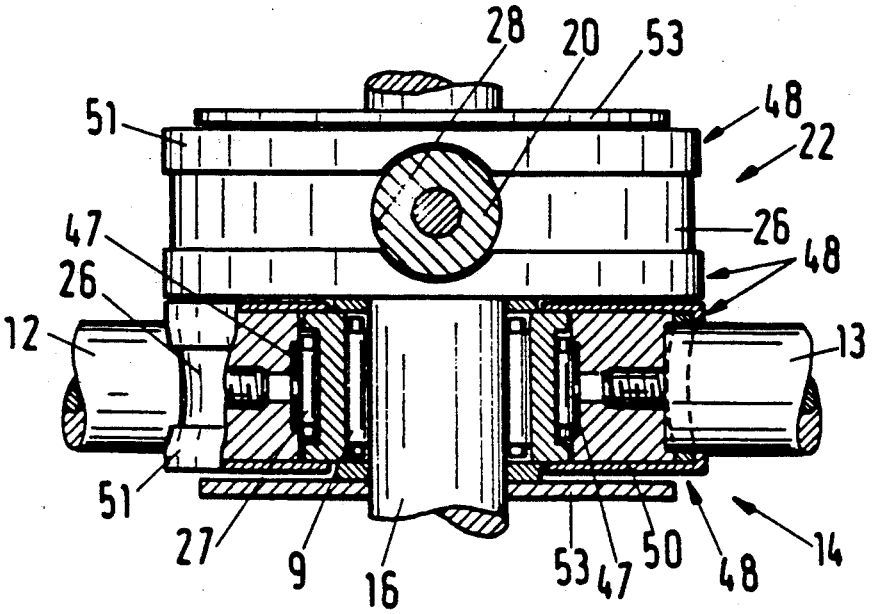
FIG. 3 illustrates a view taken on line III—III of FIG. 2.

As shown in FIGS. 2 and 3, the two clamp rings 26 may each be provided with two cover members 48 in the form of caps made from a plastic. Each cover member 48 has an end wall 50 laterally defining the interior of the clamp ring 26 and a flange part or lip 51 fitted onto a shoulder part of the associated clamp ring 26. The end walls 50 are each provided with a slot-like aperture 52 for the passage of the crankpin 16, such aperture being adapted to the range of movement of the block 15. The interiors of the yoke units 14, 22 containing the bearing systems 9 and 27 are protected from fouling by penetrating dust by means of the cover members 48 in conjunction with cover plates 53 which are fitted on the crankpin 16 and which cover the apertures 52.

The clamp ring 26, the shoes 23 connected to the piston rods 12, 13 and 20, 21, respectively, and the block 15 form a self-supporting mounting unit which is guided in the respective pair of cylinders 1, 3, and 2, 4, respectively, disposed opposite one another. The screwless, resiliently deformable connection between the shoes 23 permits compensation of inaccuracies of the cooperating parts, especially a partial shifting of the shoes 23 in a circumferential direction of the clamp ring 26. Correspondingly, the shoes 23 can adjust exactly parallel to the guide surfaces 29 of the block 15 under a substantially constant biasing force of the clamp ring 26. Further, the clamp ring 26 ensures an even allotment of the biasing force to the block 15.

In a modified embodiment (not shown), the mounting for two cooperating shoes 23 may comprise two supporting clamp rings disposed axially offset on either side of the piston rods 12, 13 and 20, 21, respectively, and adapted each to be fitted with prestressing onto the shoulder parts of the shoes 23 opposite one another. Correspondingly, for mounting and demounting of these clamp rings, the shoes can be kept in touch with the piston rods. Also, the shoes can be integral with the piston rods. Instead of clamp rings, it is also possible to use other mountings with connecting parts releaseable from and braceable against the shoes.

The invention is not limited to compressors of the type described hereinbefore and illustrated but is also suitable for two-stage or multi-stage compressors and for other applications, e.g. breathing apparatus compressors, compressors for low-temperature technology and the like.

The invention thus provides a reciprocating compressor of relatively simple construction wherein play between the pistons and sliding block is reduced to a minimum.

Further, the invention provides a reciprocating compressor which can be readily disassembled for repair and maintenance purposes. In this respect, the yoke units may be removed from the compressor for maintenance purposes without having to dismantle the entire piston and cylinder assemblies therefrom.

What is claimed is:

1. A self-supporting mounting unit for a reciprocating compressor comprising at least a pair of pistons disposed on a common axis;

a sliding block disposed between said pistons for movement transversely of said axis, said block having a pair of mutually parallel flat guide surfaces perpendicular to said axis;

a pair of shoes, each shoe being secured to a respective piston and disposed between a respective piston and said block, each shoes having a flat guide surface facing a respective flat guide surface of said block and a cylindrical support surface; and at least one elastically deformable supporting clamp ring surrounding said shoes and said block for biasing said shoes towards said block and parallel to said axis under a prestress, said ring being disposed on said cylindrical support surface of each shoe.

2. A mounting unit as set forth in claim 1 which further comprises a cover member having a central opening receiving a crankpin therein and a circumferential flange disposed over and about said clamp ring.

3. A mounting unit as set forth in claim 1 which further comprises a wear-resistant lining disposed on and between at least one of said block and a respective shoe.

4. A mounting unit as set forth in claim 1 which further comprises a linear rolling bearing system disposed between said block and a respective shoe and a pair of lateral stops for limiting motion of said system relative to said respective shoe.

5. A self-supporting mounting unit for reciprocating compressor comprising at least a pair of pistons disposed on a common axis;

a sliding block disposed between said pistons for movement transversely of said axis;

a pair of shoes, each shoe being removably secured to a respective piston and disposed between a respective piston and said block, each shoe having a flat guide surface facing a respective flat guide surface of said block and a cylindrical support surface; and means bearing on said cylindrical support surface of each shoe and biasing said shoes under a prestress towards said block and parallel to said axis.

6. A mounting unit as set forth in claim 5 wherein said means includes at least one clamp ring surrounding said shoes.

7. A mounting unit as set forth in claim 6 wherein said ring has a pair of diametrically opposed openings for passage of said respective pistons therethrough.

8. A reciprocating compressor comprising at least one pair of cylinders disposed on a common axis;

at least a pair of pistons, each piston being reciprocally mounted in a respective cylinder on said axis;

a sliding block disposed between said pistons on said axis;

a crankpin disposed in said block for moving said block transversely of said axis;

a pair of shoes, each shoe being secured to a respective piston and disposed between a respective piston and said block, each shoe having a guide surface facing said block;

a linear rolling bearing system disposed between said block and a respective shoe; a pair of lateral stops for limiting motion of said bearing system relative to said respective shoe;

at least one elastically deformable supporting clamp ring surrounding said shoes and said block for biasing said shoes towards said block and parallel to said axis under a prestress; and a pair of clamping members disposed within said clamp ring, each clamping member being disposed against said shoes in bridging relation to said block and having said lateral stops thereon.

9. A reciprocating compressor as set forth in claim 8 wherein each shoe has a cylindrical support surface receiving said clamp ring thereon.

10. A reciprocating compressor as set forth in claim 8 which further comprises a cover member having a central opening receiving said crankpin therein and a circumferential flange disposed over and about said clamp ring.

11. A reciprocating compressor comprising at least one pair of cylinders disposed on a common axis;

at least a pair of pistons, each piston being reciprocally mounted in a respective cylinder on said axis;

a sliding block disposed between said pistons on said axis;

a crankpin disposed in said block for moving said block transversely of said axis;

a pair of shoes, each shoe being removably secured to a respective piston and disposed between a respective piston and said block, each shoe having a guide surface facing said block;

at least one clamp ring means bearing on and biasing said shoes under a prestress towards said block and parallel to said axis; and a pair of clamping members disposed within said clamp ring, each clamping member being disposed against said shoes in bridging relation to said block for biasing said clamp ring outwardly of said axis.

12. A reciprocating compressor as set forth in claim 11 wherein said ring has a pair of diametrically opposed openings for passage of said respective pistons therethrough.

13. A reciprocating compressor as set forth in claim 11 wherein each shoe has a cylindrical support surface receiving said clamp ring thereon.

* * * * *

UNITED STATES PATENT AND TRADEMARK OFFICE

CERTIFICATE OF CORRECTION

PATENT NO. : 5,030,065

DATED : July 9, 1991

INVENTOR(S) : HEINZ BAUMANN,

It is certified that error appears in the above-identified patent and that said Letters Patent is hereby corrected as shown below:

Column 5, line 35 change "shoes" to -shoe-

Signed and Sealed this

Fifteenth Day of December, 1992

*Attest:*

DOUGLAS B. COMER

*Attesting Officer*

*Acting Commissioner of Patents and Trademarks*